US006205982B1

(12) United States Patent
Blomquist et al.

(10) Patent No.: US 6,205,982 B1
(45) Date of Patent: Mar. 27, 2001

(54) PROPORTIONAL PURGE SOLENOID CONTROL SYSTEM

(75) Inventors: William B. Blomquist, Clarkston; Michael W. Weglarz, Macomb Township, both of MI (US)

(73) Assignee: Chrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/079,706

(22) Filed: May 15, 1998

(51) Int. Cl.[7] ..... F02M 33/02
(52) U.S. Cl. ..... 123/520; 123/357
(58) Field of Search ..... 123/458, 520, 123/519, 518, 516, 357

(56) References Cited

U.S. PATENT DOCUMENTS

| | | | | |
|---|---|---|---|---|
| 4,326,489 | | 4/1982 | Heitert . | |
| 4,446,838 | | 5/1984 | Suzuki . | |
| 4,703,736 | | 11/1987 | Atkins, Sr. . | |
| 4,821,701 | | 4/1989 | Nankee et al. . | |
| 5,060,621 | * | 10/1991 | Cook | 123/516 |
| 5,237,980 | * | 8/1993 | Gillier | 123/458 |
| 5,255,661 | | 10/1993 | Nankee, II et al. . | |
| 5,263,460 | | 11/1993 | Baxter et al. . | |
| 5,413,082 | * | 5/1995 | Cook | 123/458 |
| 5,460,137 | * | 10/1995 | Zabeck | 123/516 |
| 5,495,749 | | 3/1996 | Dawson et al. . | |
| 5,609,136 | * | 3/1997 | Tuken | 123/357 |
| 5,682,869 | | 11/1997 | Nankee, II et al. . | |
| 5,727,532 | * | 3/1998 | Everingham | 123/458 |
| 5,791,318 | * | 8/1998 | Schulz | 123/520 |
| 5,893,354 | * | 4/1999 | Detweiler | 123/520 |

* cited by examiner

*Primary Examiner*—Carl S. Miller
(74) *Attorney, Agent, or Firm*—Mark P. Calcaterra

(57) ABSTRACT

A method for controlling fuel vapor purge flow in an automotive type internal combustion engine. The method includes the steps of determining existence of a purge ON condition and determining a simulated engine airflow value. A desired purge flow is calculated as is a value for a desired purge solenoid current. Utilizing a PID control methodology, the desired purge solenoid current is produced and a purge driver generates a PWM signal with to control a purge solenoid with the purge solenoid.

18 Claims, 2 Drawing Sheets

PROPORTIONAL PURGE SOLENOID CONTROL SYSTEM

BACKGROUND OF THE INVENTION

1. Field of the Invention

The present invention relates generally to a control system for an internal combustion engine. More particularly, the present invention relates to a method and device for controlling a purge solenoid for a control system of an internal combustion engine.

2. Background Information

Under normal operating conditions, fuel evaporates from inside an automotive vehicle's fuel tank. These vapors are temporarily stored inside of a vapor storage canister generally known as a purge canister or vapor canister. A typical purge canister contains a quantity of activated charcoal as the preferred medium for storing the fuel vapors. Because the purge canister's storage capacity is limited by the charcoal becoming saturated with absorbed fuel vapor, it is necessary to periodically purge the canister with fresh air to remove the fuel vapor.

Typically, a control system is used to purge the canister. The control system includes a purge solenoid which is turned ON and OFF to control fuel vapor purged from the purge canister to the internal combustion engine. An example of such a control system is disclosed in U.S. Pat. No. 5,263,460, issued to Baxter et al. and in U.S. Pat. No. 4,821,701, issued to Nankee II et al., the disclosures of which are hereby incorporated by reference. Although the above systems have worked well for their intended purposes, there exists a need to better control and vary the amount of purge flow from the purge canister to the internal combustion engine.

It is therefore one object of the present invention to provide a method of controlling purge flow to an internal combustion engine.

It is another object of the present invention to provide a method of varying the amount of purge flow to the internal combustion engine.

It is yet another object of the present invention to utilize a linear purge control solenoid, also known as a proportional purge solenoid (PPS), to control fuel vapor purged from the purge canister.

It is a further object of the present invention to provide a pulse width modulated (PWM) driver to allow for accurate purge flow scheduling.

To achieve the foregoing objects, the present invention is a method of controlling a proportional purge solenoid for a purge control system of an internal combustion engine. The present method obtains a desired target current based upon the engine vacuum and the desired purge flow. PID feedback is incorporated in the desired target current flow through the modifying of the delivered duty cycle to the proportional purge solenoid driver.

One advantage of the present invention is that the method will allow for more accurate control of a linear purge control solenoid. The flow through a linear purge control solenoid is best controlled using a current feedback method since the coil resistance varies with changes in operating temperature.

Additional objects, features and advantages of the invention will become more fully apparent to persons skilled in the art from a consideration of the Detailed Description of the Preferred Embodiment and the appended claims, both when taken in conjunction with the accompanying drawings.

DETAILED DESCRIPTION OF THE PREFERRED EMBODIMENT

Figure 1:
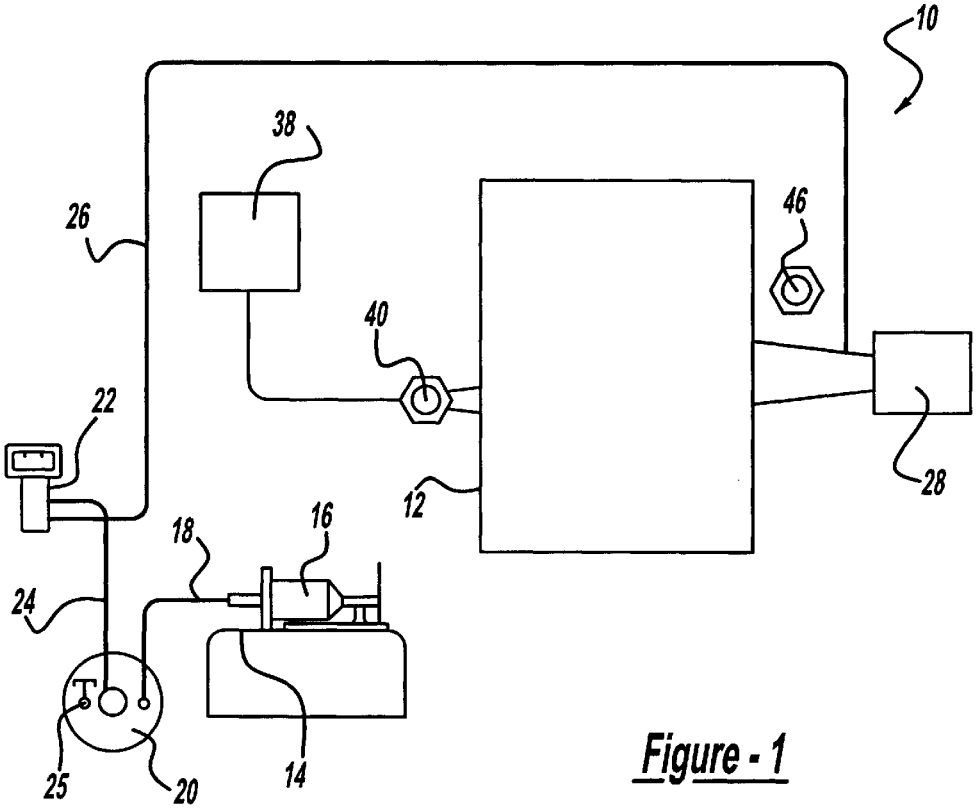
FIG. 1 is a schematic view illustrating a purge control system of an automotive vehicle in relation to various other aspects of an internal combustion engine.

Referring now to the drawings, seen in FIG. 1 is a purge control system, designated at 10, for an internal combustion engine 12 of an automotive vehicle (not shown) according to the principles of the present invention. The purge control system 10 includes a fuel tank assembly 14 having a pressure relief roll-over valve 16 connected by a conduit 18 to canister 20 that is often referred to as either a vapor storage or purge canister. The latter terminology is being adopted and used herein.

Under normal operation conditions, fuel vapors form in the fuel tank assembly 14 and excess vapors are directed from the fuel tank assembly 14 through the pressure relief/roll-over valve 16 and the conduit 18 into the purge canister 20. In the purge canister 20, fuel vapor is temporarily stored until a "purge-On" situation is detected by the purge control system 10.

The purge control system 10 also includes a linear solenoid device 22, also known as a proportional purge solenoid (hereinafter just "PPS") PPS. The PPS 22 is connected by one conduit 24 to the purge canister 20 and by another conduit 26 to a throttle body assembly 28.

Figure 2:
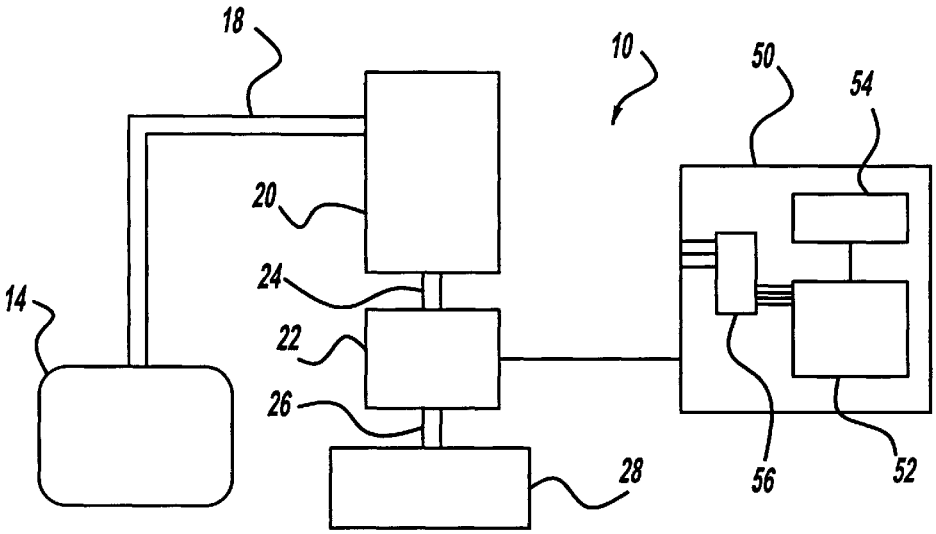
FIG. 2 is a schematic view illustrating the basic components of the proportional purge control system of FIG. 1.

Referring to FIG. 2, seen therein is a schematic diagram which illustrates the basic components of the purge control system 10. The purge control system 10 includes an Electronic Control Unit (ECU) 50 which controls the proportional purge solenoid 22. The ECU 50 includes a MicroProcessing Unit (MPU) 52, memory 54, Input/Output (I/O) module 56, and other hardware and software to control fuel to air ratios, fuel spark timing, EGR, and other tasks of engine control. It should be appreciated that when the ECU 50 turns ON the proportional purge solenoid 22, fuel vapor is purged from the purge canister 20 and through the conduit 24, the purge solenoid 22 and the conduit 26 into the throttle body assembly 28. It should also be appreciated that the purge control system 10 may include other sensors, transducers or the like in communication with the ECU 50 to carry out the method more fully described below.

Referring now to both FIGS. 1 and 2, fuel vapors are temporarily stored in the purge canister 20 until a purge ON situation, such as hot engine operating conditions, is detected by the purge control system 10. Under a purge ON situation, the PPS 22 is engaged by the control system's ECU 50. Once engaged, the PPS 22 causes negative pressure, originating from the manifold of the engine, to be applied to a vacuum control line (not shown) of the purge control system 10. The applied negative pressure through the PPS 22 causes fuel vapor to be purged from the purge canister 20 through conduit 24 by the drawing and inflow of fresh air into the purge canister 20 through a fresh air port 25. During purging, the purge flow travels through conduit 26 into the throttle body assembly 28.

Figure 3:
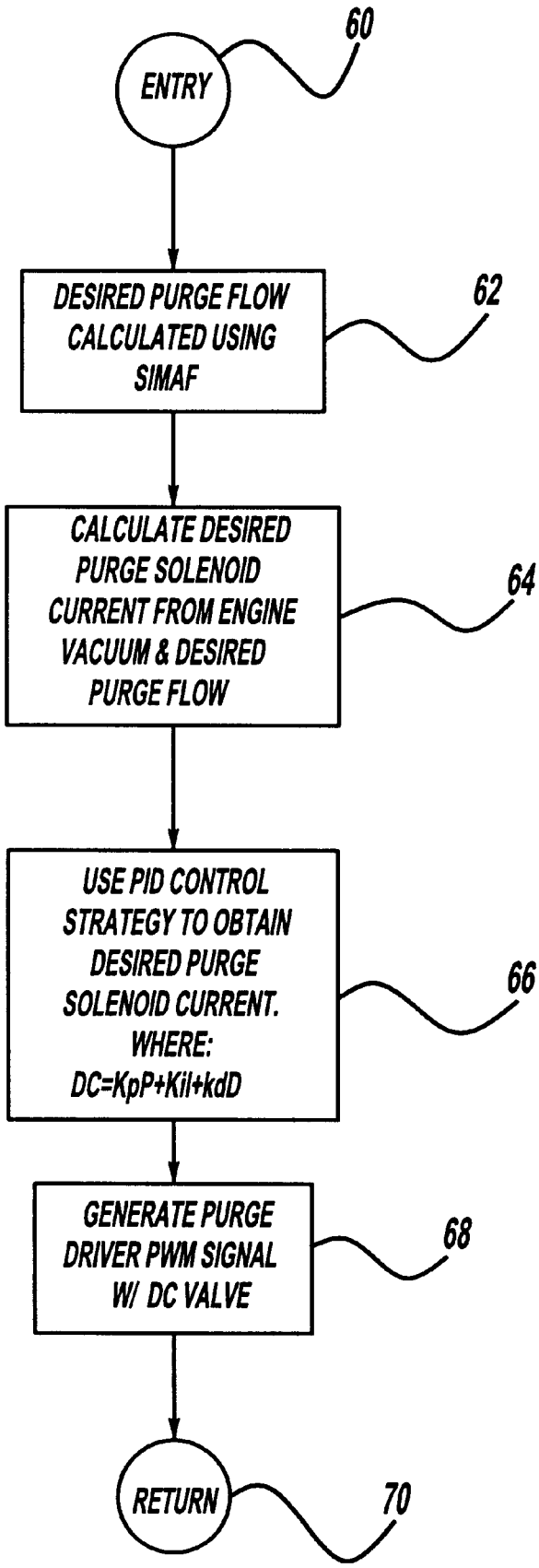
FIG. 3 is a flow chart depicting a method of controlling the purge control system of FIG. 1.

Referring to FIG. 3, a flowchart of a method of controlling the purge solenoid 22 for the purge control system 10 is illustrated. The routine or methodology determines whether the purge solenoid 22 should be enabled (ON) or disabled (OFF). This methodology is performed after the ECU 50 determines that purge enable conditions are satisfied and calculates a Simulated Engine Airflow (SIMAF). Determining that purge enable conditions are satisfied and calculating SIMAF are both performed using conventional techniques.

More specifically, step 60 signifies the entry into the methodology. At step 62 the desired purge flow is calculated using the SIMAF equation. A surplus look up table is used to define the required electrical current to be delivered to the PPS:[9×9 3D table]{PX3_PRGFLW}. The table utilizes the following parameters:

x=Purge flow=0 to 100% flow=$00 to $FF y=Vacuum=0 to 787.44 torr=$00 to $FF z=Desired Current=0 to 670 mA=$00 to $FF A 2D table is used to define the break points for the 3D table {PX2_PRGSCL}. After calculating the desired purge flow in step 62 we now enter step 64 where the calculated desired purge Solenoid current from the engine vacuum and desired purge flow is calculated.

Following the calculation of the desired purge Solenoid current step 66 is executed and PID control is used to obtain the desired purge Solenoid current where DC=KpP+KdD+Kil. The algorithm is defined as:

```
P   =   Proportional Error {PXB_PRGERR} [16-Bit Signed]
        [-255 to 255]
    =   {PXB_DESPRG - PXB_DCPFBK}
D   =   Derivative Error {PXB_PRGDER} [16-Bit Signed]
        [-255 to 255]
    =   P - Plast
    =   {PXB_PRGERR - PXB_PRERRL}
    Plast = PXB_PRERRL = PXB_PRGERR after calculation of
        PXB_PRGDER
    Initial Conditions for Plast:
    Plast = PXB_PRGERR before calculation of D on first entry
        into PID algorithm at power-up or after purge free cell update
        with purge off
        ie. D= 0 for first iteration
I   =   Integral Error {PXW_PRGINT} [16-Bit Signed] [-32768 to
        32767]
    =   I + P
    =    {PXW_PRGINT + PXB_PRGERR}
    Initial conditions for I term:
    I=  0 on power-up
    =   0 when in purge free cell update (purge off)
Kp  =   Proportional term gain [Calibration constant]
        {PXC_PROGAN}
        Units = %/255; H = Gain * 128
Kd  =   Derivative term gain [Calibration constant]
        {PXC_DERGAN}
        Units = % /255; H = Gain * 128
Ki  =   Integral term gain [Calibration constant] {PXC_INTGAN}
        Units = % / 255; H = Gain * 128
KpP= PXB_PPROPT; PID proportional DC purge term.
    =   PXC_PROGAN * PXB_PRGERR / 128
KdD= PXB_PDERT: PID derivative DC purge term.
    =   PXC_DERGAN * PXB PRGDER / 128
Kil =   PXB_PINTT: PID integral DC purge term.
    =   PXC_INTGAN * PXW_PRGINT / 128
DC= ((Kp * PError) + (Kd * DError) + (Ki * IError)) / 128
```

After the current has been calculated, a purge driver PWM signal in step 68 drives the calculated current/set point to the DC valve. The current is then regulated continuously at the desired set point by the PID algorithm.

It is to be understood that the invention is not limited to the exact construction illustrated and described above, but that various changes and modifications may be made without departing from the spirit and scope of the invention as defined in the following claims.

We claim:

1. A method for controlling fuel vapor purge flow in an automotive type internal combustion engine, said method comprising the steps of:

determining existence of a purge ON condition;

determining a desired purge flow;

determining a desired purge solenoid current corresponding to said desired purge flow by looking up said desired purge solenoid current in a three dimensional table;

utilizing a PID control methodology to produce said desired purge solenoid current;

generating a purge driver PWM signal of said desired purge solenoid current; and controlling a purge solenoid with said purge driver PWM signal to control purge flow wherein said step of determining said desired purge solenoid current corresponding to said desired purge flow by looking up said desired purge solenoid current in said three dimensional table includes using a two dimensional table to define break points for said three dimensional table containing purge solenoid currents.

2. A method for controlling fuel vapor purge flow in an automotive type internal combustion engine, said method comprising the steps of:

determining existence of a purge ON condition;

determining a desired purge flow;

correlating said desired purge flow to a desired purge solenoid current using a three dimensional table containing purge solenoid currents;

initiating a PID control algorithm to generate said desired purge solenoid current, said initiating step comprising the further steps of:

monitoring actual purge solenoid current;

calculating error between said actual purge solenoid current and said desired purge solenoid current;

utilizing said error in said PID control algorithm to calculate a switching on-time; and applying said switching on-time to generate a purge driver PWM signal corresponding to said desired purge solenoid current; and controlling a purge solenoid with said purge driver PWM signal wherein said step of correlating said desired purge flow to said desired purge solenoid current using said three dimensional table containing purge solenoid currents includes using a two dimensional table to define break points for said three dimensional table containing purge solenoid currents.

3. A method for controlling fuel vapor purge flow in an automotive type internal combustion engine, said method comprising the steps of:

determining existence of a purge ON condition;

calculating a value for a desired purge solenoid current using a two dimensional table to define break points for a three dimensional table containing purge solenoid currents;

utilizing a PID control methodology to produce said desired purge solenoid current;

generating a purge driver PWM signal of said desired purge solenoid current; and controlling a purge solenoid with said purge driver PWM signal to control purge flow.

4. A method for controlling fuel vapor purge flow as set forth in claim 1 further comprising the step of determining a simulated engine airflow value.

5. A method for controlling fuel vapor purge flow as set forth in claim 4 further comprising the step of determining a desired purge flow from said simulated engine air flow value.

6. A method for controlling fuel vapor purge flow as set forth in claim 1, wherein said step of determining a desired purge flow utilizes a simulated air flow model to determine said desired purge flow.

7. A method for controlling fuel vapor purge flow as set forth in claim 1, wherein said three dimensional table includes a plurality of purge flow variables, a plurality of vacuum variables, and a plurality of desired current variables.

8. A method for controlling fuel vapor purge flow as set forth in claim 1, wherein said step of utilizing said PID control methodology to produce the desired purge solenoid current comprises:

monitoring actual purge solenoid current;

calculating the error between said actual purge solenoid current and said desired purge solenoid current; and utilizing said error in a PID algorithm to calculate a switching on-time for said PWM signal.

9. A method for controlling fuel vapor purge flow as set forth in claim 1, wherein said step of generating said purge driver PWM signal of said desired purge solenoid current comprises switching a switching element.

10. A method for controlling fuel vapor purge flow as set forth claim 9, wherein said switching element is a Thyristor.

11. A method for controlling fuel vapor purge flow as set forth claim 9, wherein said switching element is a transistor.

12. A method for controlling fuel vapor purge flow as set forth in claim 2, wherein said step of determining a desired purge flow comprises utilizing a simulated air flow model to determine said desired purge flow.

13. A method for controlling fuel vapor purge flow as set forth in claim 2, wherein said three dimensional table includes a plurality of purge flow variables, a plurality of vacuum variables, and a plurality of desired current variables.

14. A method for controlling fuel vapor purge flow as set forth in claim 2, wherein said purge driver PWM signal is generated by switching a switching element.

15. A method for controlling fuel vapor purge flow as set forth claim 14, wherein said switching element is a Thyristor.

16. A method for controlling fuel vapor purge flow as set forth claim 14, wherein said switching element is a transistor.

17. A method for controlling fuel vapor purge flow in an internal combustion engine comprising the steps of:

determining the existence of an on condition;

determining a desired purge flow;

correlating said desired purge flow to a desired purge solenoid current using a two dimensional table to define break points for a three dimensional table containing purge solenoid current;

utilizing a feedback control loop to generate said desired current comprising the steps of:

monitoring actual purge solenoid current;

calculating the error between said actual purge solenoid current and said desired purge solenoid current;

adjusting a current driver to eliminate said error, wherein said current driver controls said actual purge solenoid current.

18. A method for controlling fuel vapor purge flow as set forth claim 17, wherein said current driver is a switching element.

* * * * *